US005485733A

United States Patent [19]

Hoffman

[11] Patent Number: 5,485,733

[45] Date of Patent: Jan. 23, 1996

[54] CONCEALED MAGNETIC LOCK FOR CABINET CLOSURE

[76] Inventor: Charles G. Hoffman, 204 Sentry Dr. North, Mansfield, Tex. 76063

[21] Appl. No.: 60,645

[22] Filed: May 13, 1993

[51] Int. Cl.[6] ..... E05B 47/00; E05C 17/56

[52] U.S. Cl. ..... 70/276; 70/413; 292/251.5

[58] Field of Search ..... 70/276, 413, 78, 70/84–86; 292/251.5, 201

[56] References Cited

U.S. PATENT DOCUMENTS

| | | | |
|---|---|---|---|
| 2,673,111 | 3/1954 | Teetor | 292/251 |
| 3,492,037 | 1/1970 | Hutchinson | 292/251.5 X |
| 3,600,025 | 8/1971 | Brainard | 292/251 |
| 3,744,833 | 7/1973 | Berducone | 292/251 |
| 3,782,147 | 1/1974 | Hallmann | 70/276 |
| 3,831,986 | 8/1974 | Kobayashi | 70/276 X |
| 3,934,909 | 1/1976 | Van Natter | 292/251 |
| 4,206,588 | 5/1977 | Bisbing et al. | 292/251 |
| 4,686,841 | 8/1987 | Prunbauer et al. | 70/413 X |
| 4,848,812 | 7/1989 | Slaughter | 292/144 |
| 4,919,464 | 4/1990 | Richards | 292/251.5 |
| 5,076,623 | 12/1991 | Richards | 292/251 |
| 5,188,405 | 2/1993 | Maccaferri | 70/413 X |
| 5,257,581 | 11/1993 | Welling | 292/251.5 X |

FOREIGN PATENT DOCUMENTS

| | | | |
|---|---|---|---|
| 2330014 | 1/1975 | Germany | 70/413 |

*Primary Examiner*—Steven N. Meyers
*Assistant Examiner*—Suzanne L. Dino
*Attorney, Agent, or Firm*—Dennis T. Griggs

[57] ABSTRACT

A magnetic lock has a latch magnet positioned on a pivotal latch. An axial section of the pivotal latch is attached pivotally to a latch housing at a latch axis. The latch housing is attached to an inside of a compartment closure that is closeable against a frame to which a latch plate is attached. A plate-contact end of the pivotal latch is extended outward radially from the axial section of the pivotal latch. An axial-end magnetic pole of the latch magnet is positioned proximate the axial section of the pivotal latch. An actuation-end magnetic pole of the latch magnet is positioned proximate the plate-contact end of the pivotal latch. A reset magnet is positioned on the latch housing at an opposite side of the latch axis from a latch-plate side of the pivotal latch. Magnetic poles of the reset magnet are positioned in like-pole-to-like-pole relationship to the latch magnet, such that the reset magnet repels the latch magnet to actuate the pivotal latch in a direction of engagement with the latch plate. A magnetic handle having a key magnet stronger than the reset magnet is positional in opposite-pole relationship to the latch magnet at an opposite side of the compartment closure from the latch housing when desired to disengage the pivotal latch from the latch plate.

19 Claims, 5 Drawing Sheets

CONCEALED MAGNETIC LOCK FOR CABINET CLOSURE

FIELD OF THE INVENTION

This invention relates generally to locks, and in particular to magnetic locks for storage compartment entrances such as cabinet doors, drawers, lids and furniture panels.

1. Background of the Invention

Storage compartments are sometimes concealed behind false panels in building walls, molding framework, mantels, furniture sections and the like. Typically, the compartment door panels are secured by latches or locks which are hidden from view, but which can be accessed for opening by sliding or lifting the covering panel. Such concealed storage compartments are sometimes used as a security vault for storing valuables, such as jewelry, cash and important documents. Other sealed storage compartments are used for safe storage of dangerous chemicals, weapons and the like which should be restricted from access by children. The locking apparatus for such hidden compartments should also be concealed so that the aesthetic appearance of the furniture, cabinetry, panelings and the like is preserved. Moreover, the locking apparatus should be hidden from view so that the existence of the security compartment will not be indicated and will be known only to authorized persons. Both spring loaded mechanical latches and magnetic latches have been devised for such concealed installations.

2. Description of the Prior Art

One form of magnetic lock for storage compartment entrances known previously employed a magnetic key having magnets positional to rotate tumblers of a lock into which it was insertional. It provided the advantage of security against unauthorized operation. But the presence of an exposed keyhole caused aesthetic limitations in furniture design and indicated the location of the security compartment. Another magnetic lock system employed one magnet embedded in a swivelable latch to be swiveled closed by attraction-poled relationship of a second magnet having relatively weak magnetism. It was swiveled open with a repulsion-poled third magnet in a magnetic key having stronger magnetism than the attraction-poled second magnet. This type of lock was limited to being opened with pushing action. Other magnetic locks have provided magnetic attraction to hold doors closed but not to lock them. This is aesthetically compatible with furniture design but has no locking security. There is a need for a more convenient, aesthetically compatible and yet secure magnetic lock for storage compartment entrances.

OBJECTS OF THE INVENTION

Accordingly, the principal object of the present invention is to provide a storage compartment magnetic lock that provides security by requiring a portable magnetic handle to be placed on a closure panel position known only to the operator with the closure panel first being pushed and then pulled to open the compartment.

Another object is to provide a furniture-compartment magnetic lock that optionally requires only proper positioning and pushing of a magnetic handle to open a furniture compartment.

Another object is to provide a furniture-compartment magnetic lock that locks automatically when closed.

Another object is to provide a furniture-compartment magnetic lock that is convenient to open by merely placing a magnetic handle on a known part of the furniture and then pushing the furniture part or, optionally, pushing it and then pulling it.

A further object is to provide a storage compartment magnetic lock which does not disclose the existence or nature of a concealed compartment in furniture on which it is used.

Yet another object is to provide a furniture-compartment magnetic lock that is not visible to hinder or to distract from aesthetic design of furniture on which it is used.

SUMMARY OF THE INVENTION

The foregoing objects are accomplished by a magnetic lock having a latch magnet positioned on a pivotal latch. An axial section of t:he pivotal latch is attached pivotally to a latch housing at a Latch axis. The latch housing is attached to an inside of a compartment closure that is closeable against a frame to which a latch plate is attached. A plate-contact end of the pivotal latch is extended outward radially from the axial section of the pivotal latch. An axial-end magnetic pole of the latch magnet is positioned proximate the axial section of the pivotal latch. An actuation-end magnetic pole of the latch magnet is positioned proximate the plate-contact end of the pivotal latch.

A reset magnet is positioned on the latch housing at an opposite side of the latch axis from a latch-plate side of the pivotal latch. Magnetic poles of the reset magnet are positioned in like-pole-to-like-pole relationship to the latch magnet, such that the reset magnet repels the latch magnet to actuate the pivotal latch in a direction of engagement with the latch plate. A magnetic handle having a key magnet stronger than the reset magnet is positional in opposite-pole relationship to the latch magnet at an opposite side of the compartment closure from the latch housing when desired to disengage the pivotal latch from the latch plate.

According to one aspect of the invention, an armature is positioned in the compartment closure in magnetic proximity between the latch magnet and the key magnet.

According to another aspect of the invention, the compartment closure is a cabinet door pivotally attached to a hinge panel at a hinge edge and having a latch end to which the latch housing is attached. The cabinet door is spring-loaded to a partially-opened position by a door-opening spring that resilience-pressures the pivotal latch outwardly for frictional contact against the latch plate. A latch-release gap is maintained between the cabinet door and a spacer block on a latch panel to which the latch plate is attached. Optionally, a latch-plate cog can be positioned on the latch plate to engage a latch groove or ridge for further securing the pivotal latch against pivotal actuation without magnetic attraction with the magnetic handle.

According to yet another aspect of the invention, the compartment closure is a slidable drawer received in a drawer compartment. The drawer is spring-loaded to a partially-open position by a drawer-opening spring. The latch housing is attached to a top portion of a front panel of the drawer and the latch plate is attached to a top chest panel.

Other features and advantages of this invention will be apparent to those skilled in the art.

BRIEF DESCRIPTION OF DRAWINGS

This invention is described by appended claims in relation to description of a preferred embodiment with reference to the following drawings wherein:

DETAILED DESCRIPTION OF THE PREFERRED EMBODIMENT

In the description which follows, like parts are indicated throughout the specification and drawings with the same numerals, respectively. The drawings are not necessarily to scale, and the proportions of certain parts have been exaggerated to clarify operational aspects of the invention.

Figure 1:
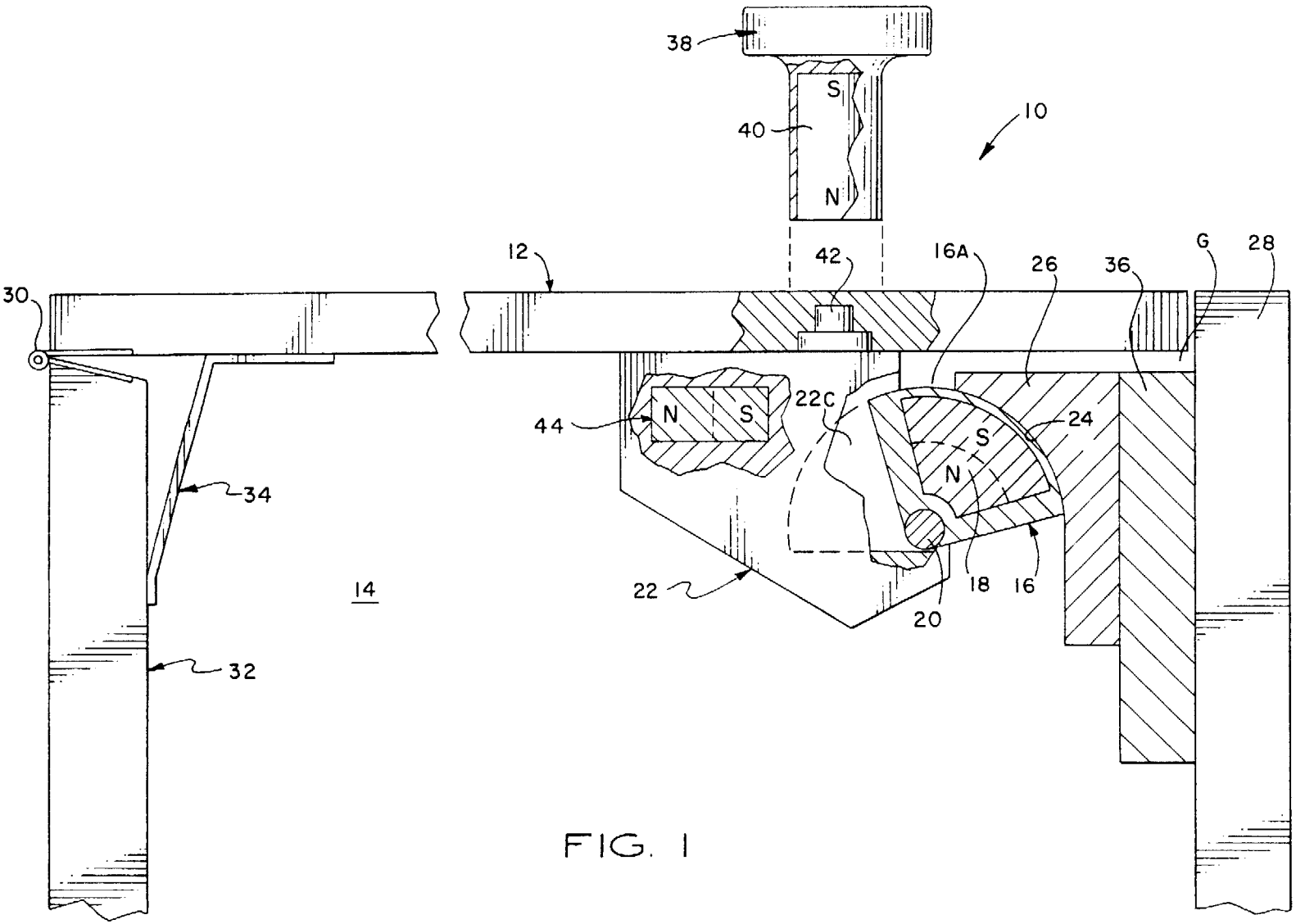
FIG. 1 is a cutaway side view of an embodiment of this magnetic lock used for hinged entrance closures such as cabinet doors. In this illustration, the lock is in a locked mode.
Figure 2:
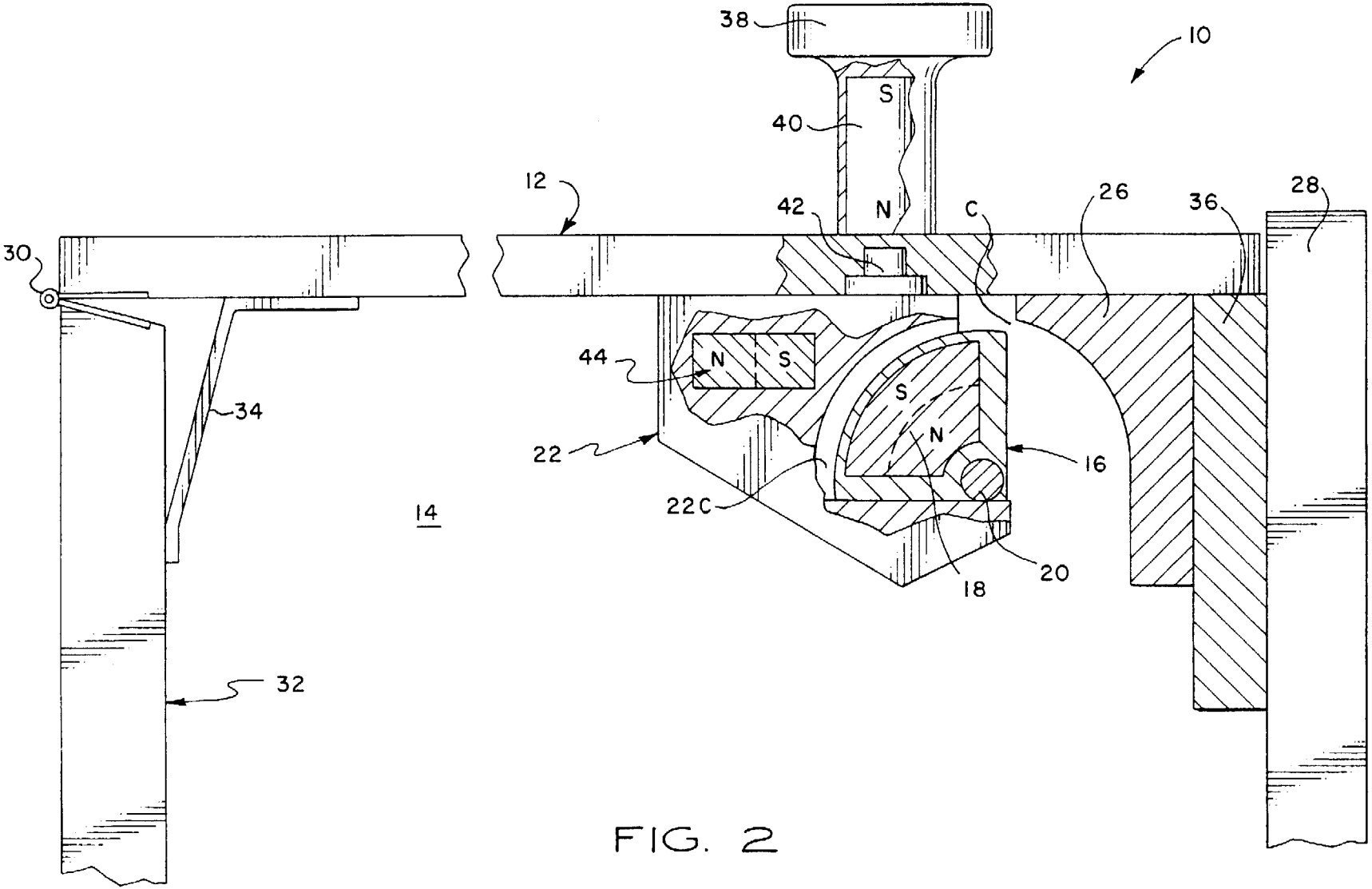
FIG. 2 is a cutaway side view of the FIG. 1 embodiment in an unlocking mode.

The magnetic lock assembly 10 of the present invention is intended for use in combination with a cabinet door or closure panel 12 which covers a storage compartment 14 which is hidden from view, and which requires two separate steps for release of the door or panel. Referring to FIG. 1 and FIG. 2 of the drawings, the magnetic lock assembly 10 includes a rotary latch member 16 in which a permanent magnet 18 is embedded. The latch 16 is mounted on a shaft 20 for rotation within the cavity 22C of a housing 22 from a latching position as shown in FIG. 1, to a released, unlocked position as shown in FIG. 2. The latch housing 22 is attached to the underside of the closure panel 12, with the latch member 16 being engaged against the curved latching surface 24 of a latch plate 26 (FIG. 1). The latch plate 26 is mounted on the front panel 28 of a cabinet or the like, and the latch housing 22 is mounted on the underside of the closure panel 12. The closure panel 12 is connected by a hinge 30 to a rear panel 32.

A spring arm 34 mounted on the closure panel 12 and engaging the rear panel 32 maintains a spring bias force on the closure panel 12 which holds it at a spacing distance G with respect to a spacer block 36. The spring force also maintains positive contact between the latch 16 and the latch plate 26. Release is obtained in two separate steps, first by placing a magnetic handle 38 and its magnetic key 40 over an armature 42 which is embedded within the closure panel 12. The magnetic key 40 is a permanent magnet having a strong magnetic force which attracts one magnetic pole of the latch magnet 18, thereby applying a magnetic retracting force onto the latch 16. Full release is obtained by pressing the closure panel 12 downwardly as shown in FIG. 2 which permits the latch 16 to clear the curved surface 24 of the latch plate 26. As the closure panel 12 is depressed downwardly, as shown in FIG. 2, a clearance gap C is produced between The outside surface 16A of the latch 16 and the curved surface 24 of the latch plate. This permits the latch 16 to rotate to the fully retracted position as shown in FIG. 2.

Upon removal of the magnetic key 40 away from the armature 42, the latch 16 is repelled by a reset magnet 44 which is enclosed within the latch housing 22. The reset magnet 44 has a south magnetic pole S which exerts a repulsion force on the south magnetic pole S of the latch magnet 18. To reestablish the locking position shown in FIG. 1, the closure panel 12 is swung downwardly, and as the face 16A of the latch 16 engages the latch plate 26, the rotary latch turns counterclockwise in opposition to the repulsion force as its front face 16A drags against the latch plate. As the closure panel 12 is displaced downwardly, it engages against the spacer block 36, the latch clears the latch plate and rotates clockwise to the locked position as shown in FIG. 1. The locked position is maintained by the spring arm 34 bias force until the closure panel 12 is depressed again. That is, the spring arm 34 maintains the latched/locked position of the rotary latch. The resilient spring arm 34 and rotary magnetic latch assembly 10 makes possible the press-to-release feature and the press-to-reset feature.

Referring again to FIG. 1, the latch magnet 18 is embedded within the pivotal latch 16. The pivotal latch 16 is rotatably coupled to the latch housing 22 by the pivot shaft 20. The reset magnet 44 is positioned in like-pole-to-like-pole relationship to one end of the latch magnet 18 to cause magnetic repulsion pivotally between the latch magnet 18 and the reset magnet 44. The magnetic repulsion actuates the pivotal end opposite the latch axis 20 of the pivotal latch 16 in a pivotal direction towards the latch plate 26. The latch housing 22 is attached to the inside surface of the closure door 12, which may be a cabinet door, panel, or section of furniture.

Referring to FIGS. 1 and 2, the closure door 12 is closed by pushing it directly and causing the pivotal latch 16 to be forced against the magnetic repulsion force by the latch 16 to a sufficiently closed position to clear the latch. To open the closure panel 12, the magnetic handle 38 is first positioned on an outside surface of the closure panel 12 proximate the conductive armature 42. The key magnet 40 has a stronger magnetic force than the reset magnet 44. One end of the key magnet 40 is positioned proximate the armature 42 with opposite-pole-to-opposite-pole magnetic-attraction relationship to the pivotal end of the latch magnet 16. The magnetic attraction of the key magnet 40 overpowers the magnetic repulsion of the reset magnet 44 and actuates the pivotal latch 16 to an unlatched position (FIG. 2) that clears the latch plate 26 when the closure door 12 is also pushed inwardly to relieve frictional contact of the pivotal latch 16 against the latch plate 26. Frictional contact of the pivotal latch 16 against the latch plate 26 is caused by the spring arm 34 which imparts opening pressure against the door 12 in opposition to the compartment hinge wall 32 to which door 12 is attached. Other types of springs, such as spring-loaded hinges, may be used to good advantage as a substitute for the hinge 30 and spring arm 34.

Figure 3:
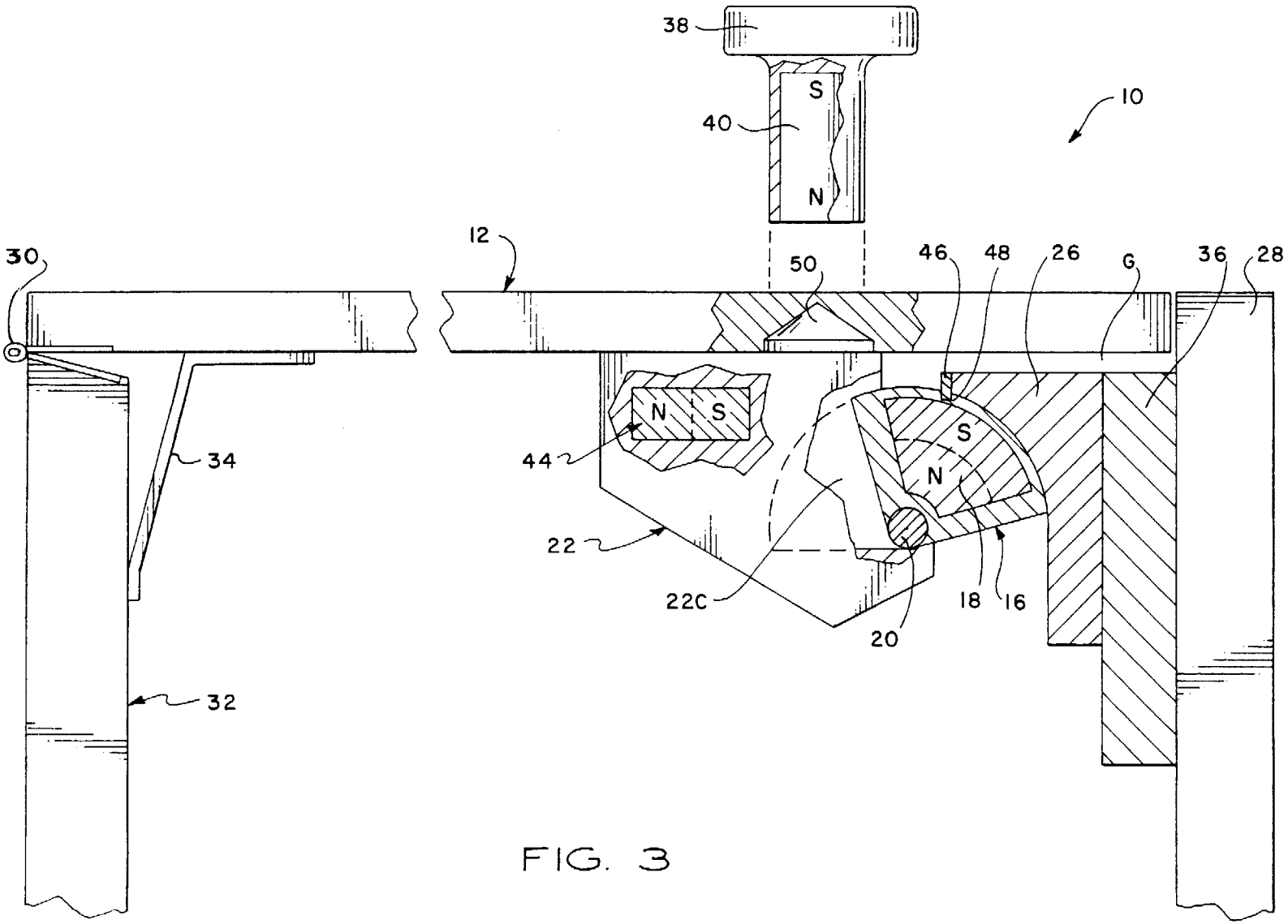
FIG. 3 is a cutaway side view of a variation of the FIG. 1 embodiment with a locking cog and a cavity instead of an armature for conveying magnetic power from a magnetic handle.

Referring to FIGS. 1, 2 and 3, the closure panel 12, or other compartment closure, abuts against the spacer block 36 after traversing the separation gap G when pushed inwardly. The width of the separation gap G is sufficient to relieve friction or to allow disengagement of additional locking members such as a latch-plate cog 46 which is latchable within a latch-cog pocket 48 in the pivotal latch 16 as shown in FIG. 3. The latch plate 26 is attached to the spacer block 36 and the spacer block 36 is attached to the front panel 28.

As shown in FIG. 3, the armature 42 may be omitted. By providing a thin-walled cavity or a pocket 50 at an inside portion of the closure door 12 or other compartment closure, magnetic flux may be coupled directly from the handle magnet 40 to the latch magnet 18.

Figure 4:
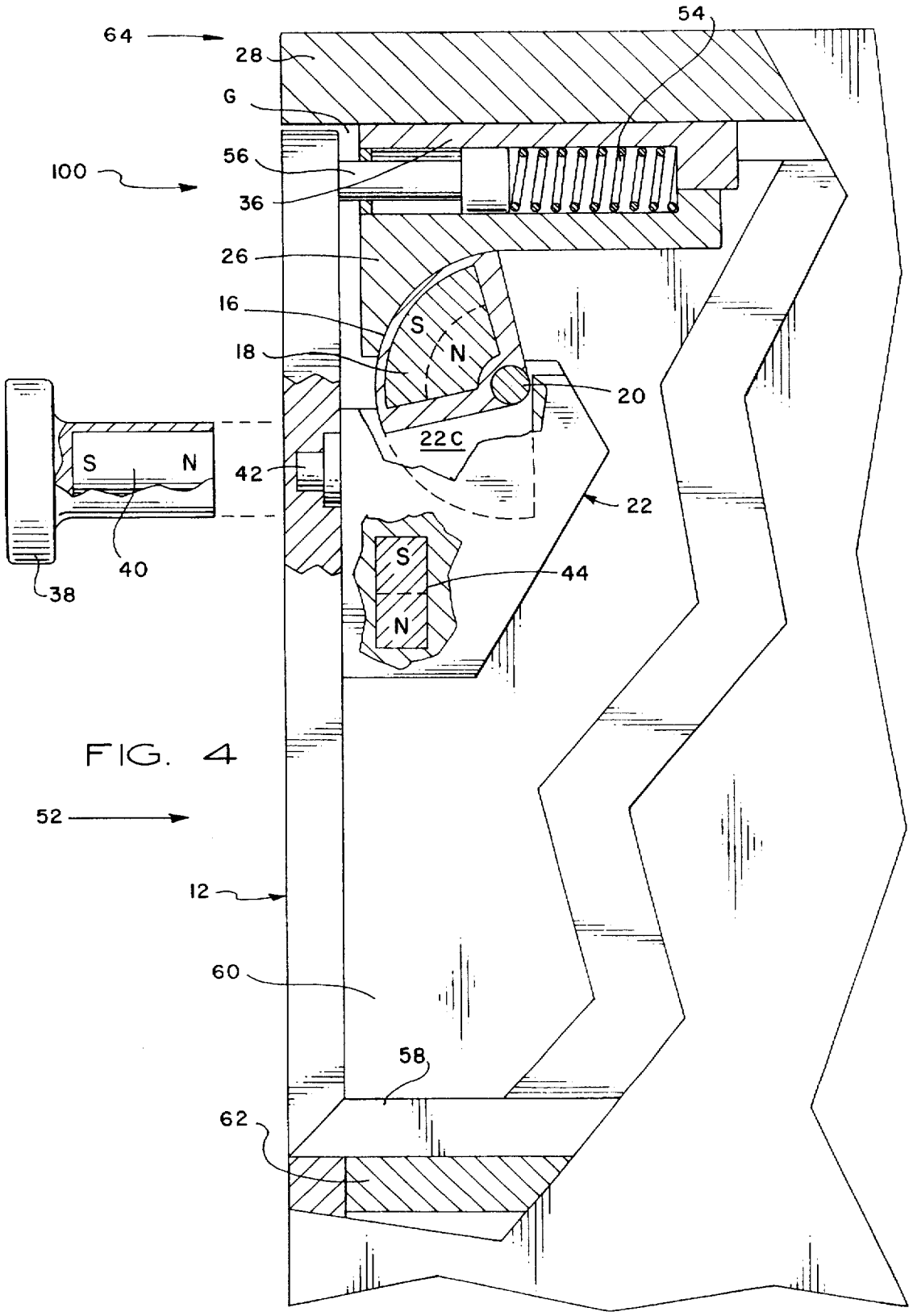
FIG. 4 is a cutaway side view of an embodiment of this magnetic lock modified for locking drawers.

Referring to FIG. 4, a lock assembly 100 is installed in a furniture chest, the closure panel 12 and front panel 28 form a part of a drawer 52 installed in the chest. A coil spring 54 may be positioned to apply drawer-opening bias force to a closure plunger 56 which actuates the pivotal latch 16 against the latch plate 26 in the locking mode as described in relation to FIGS. 1–3.

The drawer 52 may be opened with the coil spring 54 and closure plunger 56 sufficiently for hand-grasping of the drawer front panel 12 if the closure plunger 56 is long enough. Ordinarily, a light-weight closure panel 12 such as a lid or drawer may be opened with the magnetic handle 38. However, in the event of difficulty in being opened fully, grasping of the closure panel 12 is possible when pushed partly open by the coil spring 54 or the spring arm 34, respectively.

The drawer 52 has a bottom wall 58, a side wall 60 and a rear wall (not shown) in addition to the drawer front panel 12 that form a closure. The drawer spring 54, with or without the plunger 56, may be positioned to be actuated against either the drawer back wall or the drawer front panel 12. The drawer 52 rides on a race 62 in a chest having one or more drawers.

Figure 5:
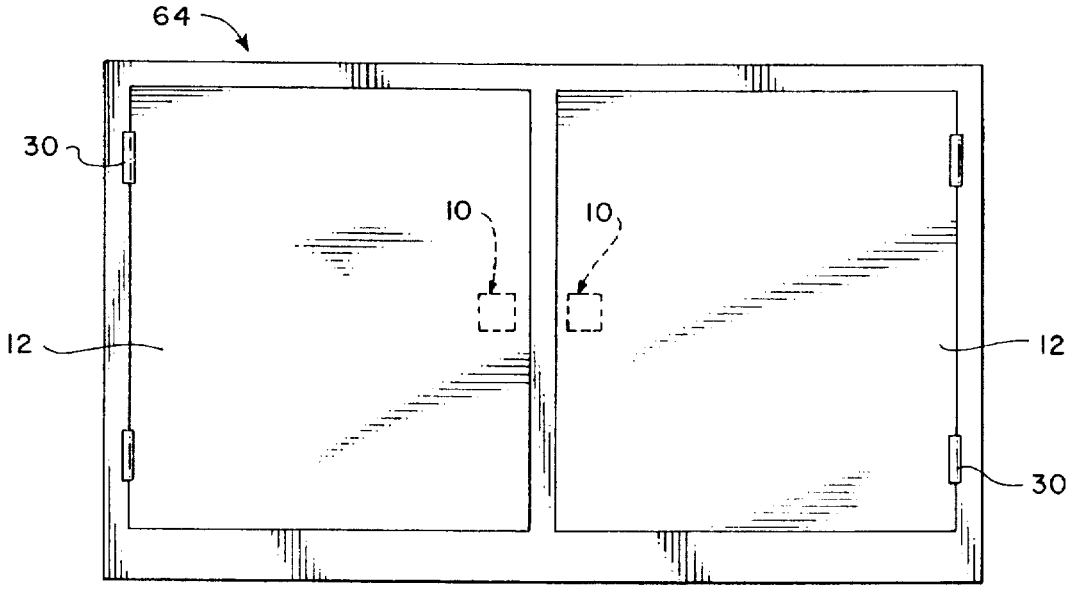
FIG. 5 is a front view of a cabinet on which this magnetic lock is used without handles on the doors.
Figure 6:
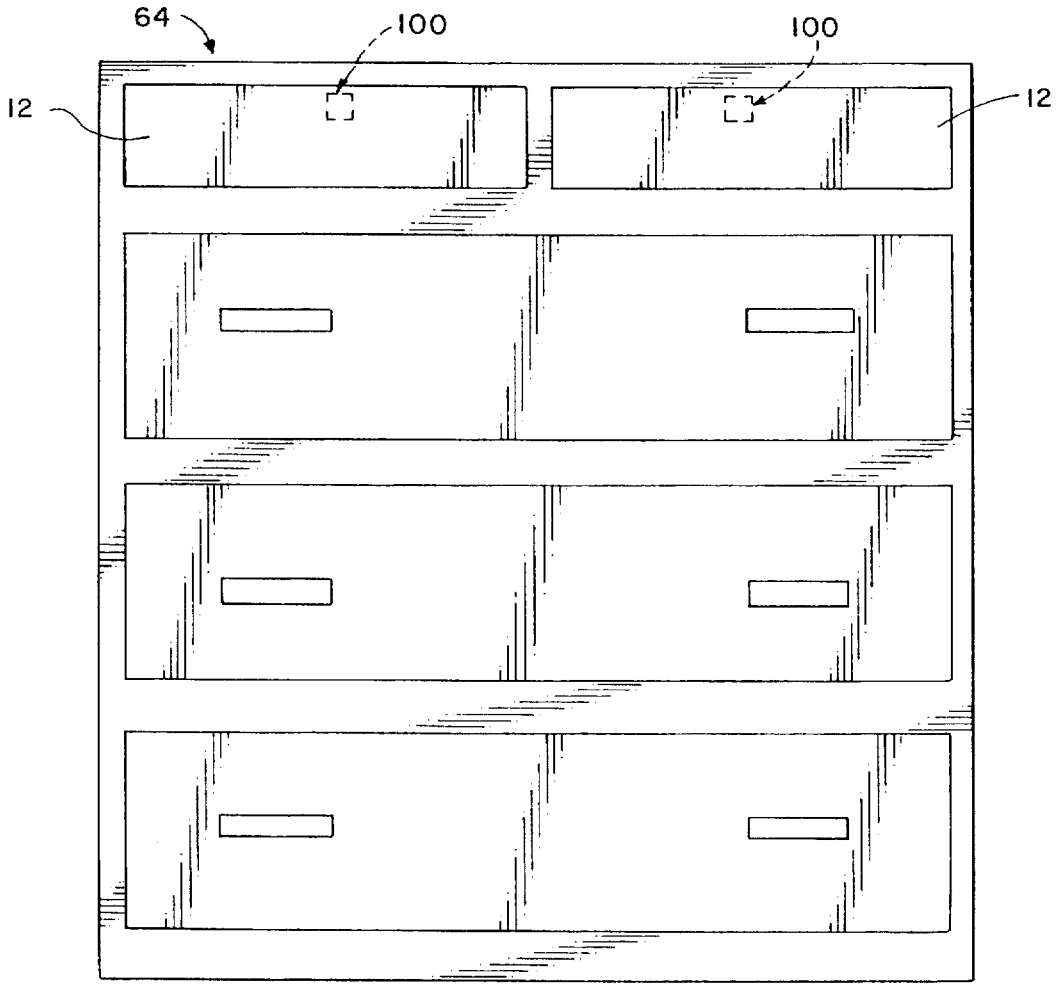
FIG. 6 is a front view of a chest of drawers on which this magnetic lock is used without handles on the drawers.

The compartment 14 closable by the panel 12 may be a room, a chest other than a drawer chest, a cabinet, a jewelry box or any other type of compartment. A chest 64 having concealed magnetic lock assemblies 10, installed in top and front locations, respectiviely, is shown in FIGS. 4 and 5.

The closure panel may be flush with a wall of a structure with which the closure is used. No external handles are required. Clean lines are made possible. Locking and unlocking are simple and convenient. Only one magnetic handle is needed for a plurality of doors and drawers.

A new and useful magnetic lock assembly having been described, all such modifications, adaptations, substitutions of equivalents, combinations of components, applications and forms thereof as described by the following claims are included in this invention.

What is claimed is:

1. A magnetic lock comprising:

a pivotal latch attached pivotally at a latch axis to a latch housing that: is attachable to a closure member in closure relationship to a compartment;

a latch plate attachable to a latch panel;

a latch magnet having a first magnetic pole proximate the latch axis and a second magnetic pole positioned outward radially from the first magnetic pole on the pivotal latch;

a reset magnet positioned on the latch housing in like-pole-to-like-pole magnetic-repulsion relationship to the second magnetic pole of the latch magnet, such that magnetic repulsion between the reset magnet and the latch magnet actuates the pivotal latch pivotally in latch-engageable contact with the latch plate;

a magnetic handle having a magnetic-actuation end with a key magnet having a magnetic pole in opposite-pole-to-opposite-pole magnetic-attraction relationship to the second magnetic pole of the latch magnet positional intermediate the latch magnet and the reset magnet on an opposite side of the closure member;

the key magnet having magnetic force to overpower magnetic force of the reset magnet and transmit magnetic force through the closure member to actuate the pivotal latch to a pivotal position of disengageable relationship with the latch plate;

a closure hinge wall to which the closure member is attached pivotally;

a closure latch wall positioned at an opposite side of the closure member from the enclosure hinge wall;

a space block attached intermediately to the enclosure latch wall and the latch plate, said spacer block having a spacer surface; and, wherein the position inwardly in the compartment at which the spacer surface on the spacer block relative to the closure member in the locked position provides a disengagement air gap between an inside surface of the closure and the spacer surface on the spacer block, such that inward pivoting movement of the door permits the pivotal latch to disengage from locking relationship between the pivotal hatch and the latch plate.

2. A magnetic lock as described in claim 1 and further comprising:

an armature positioned in the closure member in magnetic communication between the latch magnet and the key magnet.

3. A magnetic lock as described in claim 1 and further comprising:

a concave latch retainer on the latch plate; and a convex latch-contact projection of the pivotal latch fittable into the concave latch retainer on the latch plate.

4. A magnetic lock as described in claim 3 and further comprising:

a latch-plate cog extended inwardly from the latch plate into the concave latch retainer; and a latch-cog ridge against which the latch-plate cog is positional in locking relationship to the pivotal latch.

5. A magnetic lock as described in claim 1 wherein the closure member is a door.

6. A magnetic lock as described in claims 1 and further comprising:

a resilient door-opener member in opening-resilience relationship between the door and the closure hinge wall; and a spacer surface on an outside end of the spacer block at a position inwardly in the compartment from an outside end of the closure latch wall.

7. A magnetic lock as described in claim 6 and further comprising:

an armature positioned in the closure member in magnetic communication between the latch magnet and the key magnet.

8. A magnetic lock as described in claim 7 and further comprising:

a concave latch retainer on the latch plate; and a convex latch-contact projection of the pivotal latch fittable into the concave latch retainer on the latch plate.

9. A magnetic lock as described in claim 8 and further comprising:

a latch-plate cog extended inwardly from the latch plate into the concave latch retainer; and a latch-cog ridge against which the latch-plate cog is positional in locking relationship to the pivotal latch.

10. A magnetic lock as described in claim 1 wherein the closure member is a drawer having a drawer front wall, rear wall, bottom wall and drawer side walls.

11. A magnetic lock as described in claim 10 and further comprising:

a drawer race on which the drawer is slidable in and out of the compartment;

a compartment wall positioned at the top, bottom and sides of the compartment;

a spacer block attached intermediately to the compartment wall and the latch plate at a desired side of the compartment.

12. A magnetic lock as described in claim 11 and further comprising:

a resilient drawer-opener member in opening-resilience relationship between the drawer front wall and the compartment wall; and a spacer surface on an outside end of the spacer block at a position inwardly in the compartment from an outside edge of the compartment wall.

13. A magnetic lock as described in claim 12 wherein the position inwardly in the compartment at which the spacer surface on the spacer block is positioned allows a desired disengagement gap between an inside surface of the compartment wall and the spacer surface on the spacer block, such that inward travel of the drawer causes the pivotal latch to disengage from locking relationship between the pivotal latch and the latch plate.

14. A magnetic lock as described in claim 13 and further comprising:

an armature positioned in the drawer front wall in magnetic communication between the latch magnet and the key magnet.

15. A magnetic lock as described in claim 14 and further comprising:

a concave latch retainer on the latch plate; and a convex latch-contact projection of the pivotal latch fittable into the concave latch retainer on the latch plate.

16. A magnetic lock as described in claim 15 and further comprising:

a latch-plate cog extended inwardly from the latch plate into the concave latch retainer; and a latch-cog ridge against which the latch-plate cog is positional in locking relationship to the pivotal latch.

17. A magnetic lock comprising:

a pivotal latch attached pivotally at a latch axis to a latch housing that is attachable to a cabinet door in closure relationship to a compartment;

a latch plate attachable to a latch panel;

a latch magnet having a first magnetic pole proximate the latch axis and a second magnetic pole positioned outward radially from the first magnetic pole on the pivotal latch;

a reset magnet positioned on the latch housing in like-pole-to-like-pole magnetic-repulsion relationship to the second magnetic pole of the latch magnet, such that magnetic repulsion between the reset magnet and the latch magnet actuates the pivotal latch pivotally in latch-engageable contact with the latch plate;

a magnetic handle having a magnetic-actuation end with a key magnet having a magnetic pole in opposite-pole-to-opposite-pole magnetic-attraction relationship to the second magnetic pole of the latch magnet positional intermediate the latch magnet and the reset magnet on an opposite side of the cabinet door;

the key magnet having magnetic force to overpower the magnetic force of the reset magnet and transmit magnetic force through the closure member to actuate the pivotal latch to a pivotal position of disengageable relationship with the latch plate;

an armature positioned in the cabinet door in magnetic communication between the latch magnet and the key magnet;

a concave latch retainer on the latch plate;

a convex latch-contact projection of the pivotal latch fittable into the concave latch retainer on the latch plate;

a door-hinge wall to which the cabinet door is attached pivotally;

a door-latch wall positioned at an opposite side of the cabinet door from, the door-hinge wall;

a spacer block attached intermediately to the door-latch wall and the latch plate;

a resilient door-opener member in opening-resilience relationship between the cabinet door and the door-hinge wall;

a spacer surface on an outside end of the spacer block at a position inwardly in the compartment from an outside end of the door-latch wall;

wherein the position inwardly in the compartment at which the spacer surface on the spacer block relative to the cabinet door in the locked position provides a disengagement air gap between an inside surface of the cabinet door and the spacer surface on the spacer block, such that inward pivoting movement of the cabinet door permits the pivotal latch to disengage from locking relationship between the pivotal latch and the latch plate.

18. A magnetic lock as described in claim 17 wherein the resilient door-opener member in opening-resilience relationship between the cabinet door and the door-hinge wall is a spring arm attached to an inside surface of the cabinet door and extended obliquely in a position of resilient contact with the door-hinge wall at a near-closed position of the cabinet door.

19. A magnetic lock as described in claim 18 and further comprising:

a latch-plate cog extended inwardly from the latch plate into the concave latch retainer; and a latch-cog ridge against which the latch-plate cog is positional in locking relationship to the pivotal latch.

* * * * *